US011230128B2

(12) United States Patent
Zheng et al.

(10) Patent No.: US 11,230,128 B2
(45) Date of Patent: Jan. 25, 2022

(54) METHOD FOR PRODUCING SECURE IDENTIFICATION DOCUMENT WITH COLOR PORTRAIT AND SECURE IDENTIFICATION DOCUMENT THEREOF

(71) Applicant: SHENZHEN EMPEROR TECHNOLOGY COMPANY LIMITED, Shenzhen (CN)

(72) Inventors: Song Zheng, Shenzhen (CN); Xiaohong Tang, Shenzhen (CN); Xiaojun Jiang, Shenzhen (CN); Jiange Feng, Shenzhen (CN); Yongbing Hu, Shenzhen (CN)

(73) Assignee: SHENZHEN EMPEROR TECHNOLOGY COMPANY LIMITED, Shenzhen (CN)

( * ) Notice: Subject to any disclaimer, the term of this patent is extended or adjusted under 35 U.S.C. 154(b) by 0 days.

(21) Appl. No.: 16/772,256

(22) PCT Filed: Dec. 12, 2018

(86) PCT No.: PCT/CN2018/120437

§ 371 (c)(1),
(2) Date: Jun. 12, 2020

(87) PCT Pub. No.: WO2020/082533

PCT Pub. Date: Apr. 30, 2020

(65) Prior Publication Data

US 2021/0101397 A1 Apr. 8, 2021

(30) Foreign Application Priority Data

Oct. 23, 2018 (CN) ..... 201811233934.4

(51) Int. Cl.
*B42D 25/378* (2014.01)
*B42D 25/435* (2014.01)
(Continued)

(52) U.S. Cl.
CPC ..... *B41M 1/305* (2013.01); *B41M 3/14* (2013.01); *B42D 25/23* (2014.10); *B42D 25/378* (2014.10); *B42D 25/435* (2014.10)

(58) Field of Classification Search
CPC ..... B42D 25/378; B42D 25/435; B41M 3/14
See application file for complete search history.

(56) References Cited

U.S. PATENT DOCUMENTS

2009/0039643 A1 2/2009 Baxter
2011/0139024 A1* 6/2011 Schiffmann ..... B42D 25/378 101/368

(Continued)

FOREIGN PATENT DOCUMENTS

CN 1393837 A 1/2003
CN 2830080 Y 10/2006
CN 101908297 A 12/2010

OTHER PUBLICATIONS

International Search Report dated Jul. 23, 2019 in corresponding International application No. PCT/CN2018/120437; 4 pages.

*Primary Examiner* — Kyle R Grabowski
(74) *Attorney, Agent, or Firm* — Maier & Maier, PLLC

(57) ABSTRACT

The disclosure relates to the technical field of secure identification document, specifically to a method for producing a secure identification document with a color portrait and a secure identification document thereof. The method comprises: etching identity information on the substrate of the data surface of document by laser, and the identity information comprises a black-and-white portrait and text information; printing a color portrait in a blank space of the substrate with color ink to obtain a personalized data surface, and the color portrait is an enlargement of the black-and-white portrait in equal proportion; and printing a transparent protective layer with a transparent varnish on the (Continued)

upper surface of the personalized data surface, wherein the protective layer covers the color portrait.

10 Claims, 2 Drawing Sheets

(51) Int. Cl.

| | |
|---|---|
| ***B41M 1/30*** | (2006.01) |
| ***B42D 25/23*** | (2014.01) |
| ***B41M 3/14*** | (2006.01) |

(56) References Cited

U.S. PATENT DOCUMENTS

| | | | | |
|---|---|---|---|---|
| 2016/0096392 | A1* | 4/2016 | Jones | B42D 25/435<br>283/75 |
| 2021/0053382 | A1* | 2/2021 | Syrjanen | B42D 25/435 |

* cited by examiner

METHOD FOR PRODUCING SECURE IDENTIFICATION DOCUMENT WITH COLOR PORTRAIT AND SECURE IDENTIFICATION DOCUMENT THEREOF

FIELD

The disclosure relates to the technical field of secure identification document, specifically to a method for producing a secure identification document with color portrait and a secure identification document with color portrait.

BACKGROUND

With the development of society, secure identification documents with identity function, such passports ID Cards, and driver licenses, have been used more and more widely. To facilitate identity verification, the secure identification document in the prior art is printed with graphic or text identity information of the document holder; therefore, in order to prevent malicious falsification of the identity information on the secure identification document, anti-counterfeiting feature is the basic requirement for modern secure identification document.

In the prior art, when a secure identification document is produced, it is necessary to etch the holder's portrait and text identity information on the PC (polycarbonate) substrate of the data surface by laser; as the substrate undergoes irreversible chemical changes after laser etching, it can also effectively prevent falsification of the holder's personal information, and the process thereof is simple and suitable for on-site decentralized document issuance. However, documents produced with holder's black-and-white portrait etched by laser are not artistic and cannot satisfy modern people's aesthetic requirements for the secure identification document.

SUMMARY

The purpose of the invention is to provide a method for producing a secure identification document with the holder's color portrait and the secure identification document thereof.

The purpose of the invention is attained by the following technical solution:

The invention is a method for producing a secure identification document with a color portrait, comprising:

etching identity information on the substrate of data surface of document by laser, and the said identity information comprises a black-and-white image and text;

printing a color portrait in a blank space of the substrate with color ink to obtain a personalized data surface; the color portrait is an enlargement of the black-and-white portrait in equal proportion; and printing a transparent protective layer with a transparent varnish on the upper surface of the personalized data surface, wherein the protective layer covers the color portrait.

In the invention, before the transparent protective layer is printed on the upper surface of the personalized data surface, the method comprises:

printing the first anti-counterfeiting mark on the personalized data surface with optically variable ink; and changing the color of the first anti-counterfeiting mark and curing the mark sequentially, so that an optically variable mark is generated on the personalized data surface.

In the invention, the step of printing the transparent protective layer on the upper surface of the personalized data surface with the transparent varnish further comprises:

forming second anti-counterfeiting marks in the transparent protective layer while the transparent protective layer is printed, In the invention, there are two or more second anti-counterfeiting marks, which are evenly distributed in the transparent protective layer.

In the invention, the color ink comprises color resin ink or offset rotary ink; the transparent varnish comprises resin, linseed oil or turpentine; and the substrate comprises polyvinyl chloride or polycarbonate.

In the invention, the first anti-counterfeiting mark and the second anti-counterfeiting marks are composed of a graphic and/or text.

The invention is a secure identification document with color portrait, comprising a substrate, which is divided into the first region and the second region which do not overlap each other, and the black-and-white identity information of holder is etched on the first region, and the identity information comprises a black-and-white portrait and text information; a color portrait is printed on the second region, and the color portrait is an enlargement of the black-and-white portrait in equal proportion; a transparent protective layer is printed on the substrate, and the transparent protective layer covers the color portrait layer.

In the invention, the secure identification document further comprises an optically variable mark layer; the optically variable mark layer is printed with optically variable ink by digital printing, and the optically variable mark layer is between the color portrait layer and the transparent protective layer.

In the invention, transparent anti-counterfeiting marks are provided in the transparent protective layer.

In the invention, the transparent protective layer completely covers the substrate.

In the invention, a color portrait corresponding to the laser-etched black-and-white portrait is printed in the blank space of the substrate, and the color portrait is covered with a transparent protective layer, which effectively prevents falsification of the color portrait; with the holder's color portrait, the secure identification document produced by the invention is more aesthetic and satisfies modern people's aesthetic requirements for secure identification document.

BRIEF DESCRIPTION OF THE DRAWINGS

For ease of description, the present invention is described in detail by the following preferred embodiments and the accompanying drawings.

DETAILED DESCRIPTION

Figure 1:
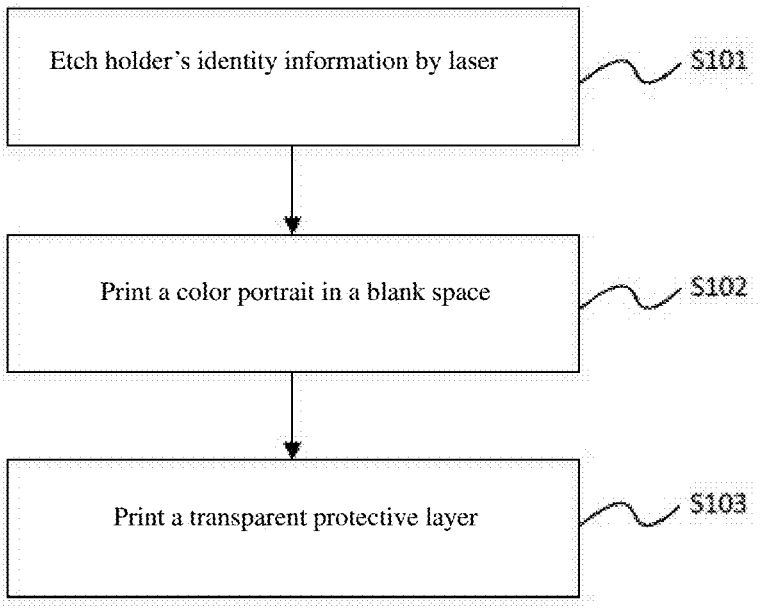
FIG. 1 is a flowchart of an embodiment of a method for producing a secure identification document according to the invention.

In order to make the objectives, technical solution, and advantages of the present invention clearer, the present invention is further described in details below with reference to the drawings and embodiments. It should be understood that the specific embodiments described herein are only used to explain the present invention and are not intended to limit the present invention.

In the description of the present invention, it should be understood that the orientation or positional relationship indicated with the terms "center", "longitudinal", "lateral", "length", "width", "thickness", "upper", "lower", "front", "back", "left", "right", "vertical", "horizontal", "top", "bottom", "inside", "outside", "clockwise", "counterclockwise", etc. are based on the orientation or positional relationship shown in the drawings, being only for the convenience of describing the present invention and simplifying the description, rather than indicating or implying that a device or an element referred to shall have a specific orientation or shall be configured or operated in a specific orientation. Therefore, it cannot be understood as a limitation to the present invention. In addition, the terms "first" and "second" are used for descriptive purposes only and cannot be understood as indicating or implying relative importance or implicitly indicating the number of technical features indicated. Therefore, the features defined as "first" and "second" may explicitly or implicitly comprise one or more of the features. In the description of the present invention, the meaning of "plurality" is two or more, unless specifically defined otherwise.

In the description of the present invention, it should be noted that the terms "installed", "interconnected", and "connected" should be understood in a broad sense unless explicitly stated and limited otherwise, and for example, the terms "installed", "interconnected", and "connected" may be fixed connection or removable connection, or integrated connection, the terms "installation", "interconnected", and "connected" can be a mechanical connection or an electrical connection. The terms "installation", "interconnected", and "connected" can be directly connected or indirectly connected through an intermediate medium, the terms "installation", "interconnected", and "connected" can be two elements internally communicated or in the interaction. For a person skilled in the art, the specific meanings of the above terms in the present invention can be understood according to specific situations.

The following embodiment describes in details a method for producing a secure identification document according to the present invention. Please refer to FIG. 1. The method comprises:

S101. Etching Holder's Identity Information by Laser

Holder's identity information is etched on the substrate of the data surface by laser; the holder's identity information comprises a black-and-white image and text information; the black-and-white image comprises a portrait of the holder, and the text information comprises: the holder's name, document number and other text information related to the holder's identity. Due to the high energy of laser, the area of the substrate surface etched can have a change in color, or even a change in surface depth; holder's identity information is etched on the substrate in a destructive manner, so it is difficult to falsify the identify information.

S102. Printing Color Portrait in the Blank Space

A color ink is used to print the color portrait in the blank space of the substrate to obtain a personalized data surface; the color portrait is an enlargement of the black-and-white portrait in equal proportion; in this embodiment, the color portrait which is an enlargement of the black-and-white portrait in equal proportion is printed in the blank space of the substrate; since the color portrait is directly printed in the region without laser etching, the color portrait will not overlay the black-and-white identity information, and the black-and-white identity information does not affect the color of the color portrait, the color portrait is therefore more vivid; and since the black-and-white portrait is consistent with the color portrait, it will not match the color portrait falsified. In this embodiment, the color portrait can be verified by the smaller black-and-white portrait, which effectively enhances the anti-counterfeiting feature of the secure identification document.

S103. Printing a Transparent Protective Layer

A transparent protective layer is printed on the upper surface of the personalized data surface by using a transparent varnish, and the protective layer covers the color portrait. Since the transparent protective layer covers the color portrait, it can protect the color portrait and effectively prevent falling of the color portrait due to daily use.

Figure 2:
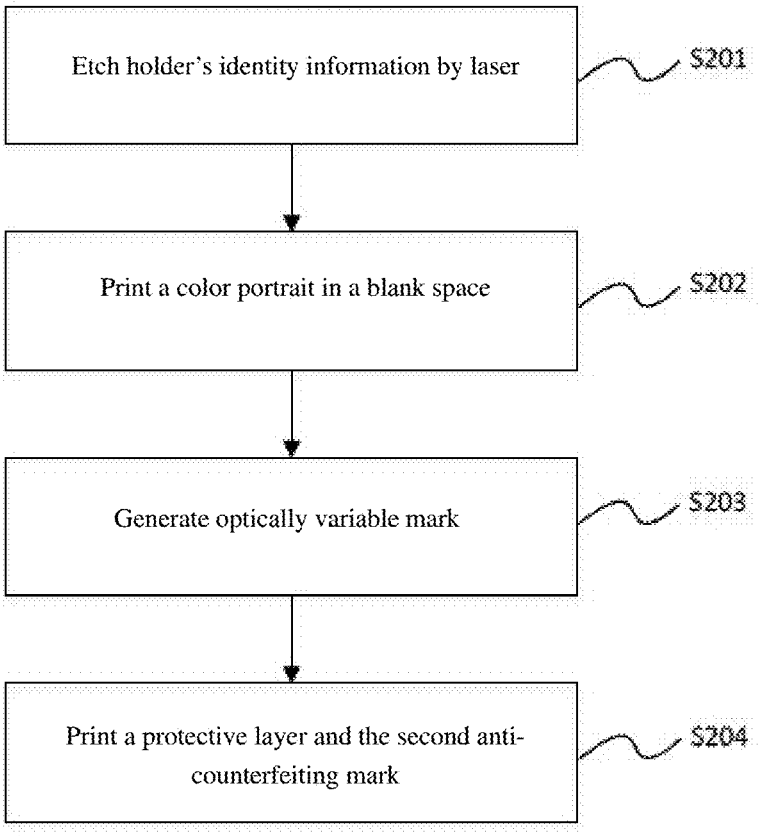
FIG. 2 is a flowchart of another embodiment of a method for producing a secure identification document according to the invention.

In order to better explain the invention, the method for producing the secure identification document of the present invention is described in details with another embodiment below. Please refer to FIG. 2. The method comprises:

S201. Etching Holder's Identity Information by Laser

The holder's identity information is etched by laser on the substrate of the data surface; the substrate comprises polyvinyl chloride (PVC) or polycarbonate (PC), and the holder's identity information comprises the black-and-white portrait and the text information; wherein the black-and-white portrait comprises the portrait of the holder, and the text information comprises the holder's name, the document number, and other text related to the identity of the holder. Due to the high energy of the laser, the region of the substrate surface that has been etched can have a change in color, or even a change in surface depth; the laser etches the holder's identity information on the substrate in a destructive manner, so it is difficult to falsify the identify information.

S202. Printing the Color Portrait in the Blank Space

Color portrait is printed with color ink in the blank space of the substrate to obtain the personalized data surface; the color portrait is an enlargement of the black-and-white portrait in equal proportion; wherein, the color ink comprises color resin ink or offset rotary ink; in this embodiment, the color portrait which is an enlargement of the black-and-white portrait in equal proportion is printed in the blank space of the substrate; since the color portrait is directly printed in the region without laser etching, the color portrait will not overlay the black-and-white identity information, and the black-and-white identity information does not affect the color of the color portrait, the color portrait is therefore more vivid; and since the black-and-white portrait is consistent with the color portrait, it will not match the color portrait falsified. In this embodiment, the color portrait can be verified by the smaller black-and-white portrait, which effectively enhances the anti-counterfeiting feature of the secure identification document.

S203. Generating an Optically Variable Mark

The first anti-counterfeiting mark is printed on the personalized data surface with optically variable ink; the first anti-counterfeiting mark consists of a graphic and/or text, specifically comprising the graphic and/or text related to the holder's identity information, or comprising graphic and/or text not related to the holder's identity information; for example, the holder's portrait or initials or other information (e.g. a trademark or a name of document issuing authority) can be used as the first anti-counterfeiting mark, which is not defined herein; and the number of the first anti-counterfeiting marks is more than one.

The first anti-counterfeiting mark is sequentially changed in color and cured, so that the optically variable mark is generated on the personalized data surface. Specifically, the color changing process can be realized by gas, electricity, light, or pressure, which is, changing the arrangement of liquid crystals. Then, the optically variable mark is rapidly cured by an UV curing agent or ultraviolet light.

Viewed from the front or from the side, the optically variable ink shows two different colors with the change of the viewing angle, with strong optical variability, great color difference, and obvious characteristics. The optically variable ink can be recognized without any equipment, the color angle effect cannot be reproduced with any high-definition scanner, color copier and other equipment, and the printing feature cannot be emulated with any other ink and printing method, showing good anti-counterfeiting reliability. Therefore, optically variable ink has been designated for currency and securities with the strictest anti-counterfeiting requirements in many countries in the world. In this embodiment, the optically variable mark printed with the optically variable ink is provided, which is more conducive to counterfeit prevention of secure identification document.

S204. Printing the Protective Layer and the Second Anti-Counterfeiting Mark

A transparent protective layer is printed on the upper surface of the personalized data surface with a transparent varnish, and the protective layer completely or partially covers the color portrait; and the second anti-counterfeiting marks are formed in the transparent protective layer while the transparent protective layer is printed; specifically, when the transparent protective layer is printed, the contour of the transparent protective layer is printed as a predetermined graphic and/or text, making the transparent protective layer a second anti-counterfeiting mark; for example, the transparent protective layer is printed in the form of a seal to cover the color portrait; or when the transparent protection layer is printed, the printing thickness of the predetermined region in the protective layer is increased or reduced, so that the second anti-counterfeiting mark with the graphic and/or the text is formed in the predetermined region; and the number of the second anti-counterfeiting marks can be one or more than two; wherein when the number of the second anti-counterfeiting marks is more than two, the second anti-counterfeiting marks are evenly distributed in the transparent protective layer. Since the transparent protective layer covers the color portrait, the transparent protective layer shall be destroyed before the color portrait is falsified; because the transparent protective layer is provided with the second anti-counterfeiting mark, when the transparent protective layer is destroyed, part of the content of the second anti-counterfeiting mark is inevitably lost, which is convenient for people to identify whether the content of the document has been falsified; the transparent varnish comprises resin, linseed oil or turpentine; the second anti-counterfeiting mark consists of graphic and/or text, and the content of the second anti-counterfeiting mark can be the same as or different from the content of the first anti-counterfeiting mark.

The invention greatly enhances the anti-counterfeiting feature of the secure identification document by overlaying and printing the color portrait and setting the first and second anti-counterfeiting marks.

Figure 3:
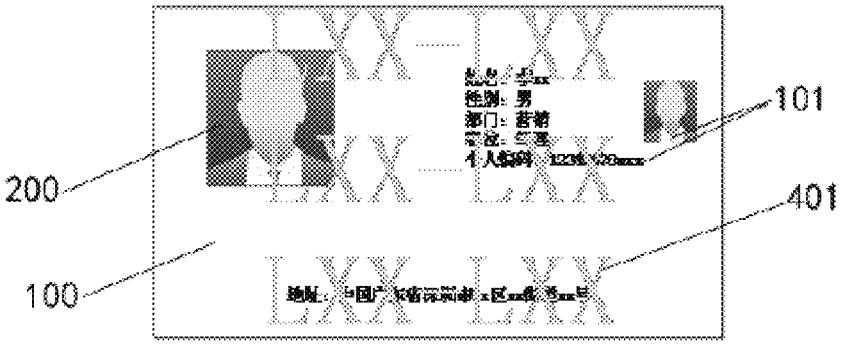
FIG. 3 is a front structural diagram of a secure identification document with color portrait according to the invention.

An embodiment of the color secure identification document of the invention is described in detail below. Please refer to FIG. 3. The color secure identification document comprises:

A substrate (100), which comprises polyvinyl chloride or polycarbonate; the substrate (100) is divided into the first region and the second region which do not overlap each other, and the first region is etched with black-and-white identity information of holder (101), the holder's identity information (101) comprises the black-and-white portrait and the text information; the text information comprises the holder's name, the document number and other text information related to holder's identity; the second region is printed with a color portrait layer (200), the image in the color portrait layer (200) is an enlargement of the black-and-white portrait in equal proportion; the transparent protective layer (not shown) is provided on the substrate (100), and the transparent protective layer (not shown) completely or partially covers the color portrait layer (200).

In this embodiment, the color portrait which is an enlargement of the black-and-white portrait in equal proportion is printed in the blank space of the substrate; since the color portrait is directly printed in the second region without laser etching in the substrate, the color portrait will not overlay the black-and-white identity information, and the black-and-white identity information does not affect the color of the color portrait, the color portrait is therefore more vivid; and since the black-and-white portrait is consistent with the color portrait, it will not match the color portrait falsified. In this embodiment, the color portrait can be verified by the smaller black-and-white portrait, which effectively enhances the anti-counterfeiting feature of the secure identification document; and the transparent protective layer (not shown) can protect the color portrait, which effectively prevents falling of the color portrait due to daily use.

In the invention, the secure identification document further comprises an optically variable mark layer (not shown); the optically variable mark layer (not shown) is printed with optically variable ink by digital printing, and the optically variable mark layer (not shown) is arranged between the color portrait layer (200) and the transparent protective layer (not shown). Viewed from the front or the side, the optically variable ink shows two different colors with the change of viewing angle, with strong optical variability, great color difference, and obvious characteristics. The optically variable ink can be recognized without any equipment, the color angle effect cannot be reproduced with any high-definition scanner, color copier or other equipment, and the printing feature cannot be emulated with any other ink or printing method, showing good anti-counterfeiting reliability. Therefore, optically variable ink has been designated for currency and securities with the strictest anti-counterfeiting requirements in many countries in the world. In this embodiment, the optically variable mark printed with optically variable ink is provided, which is more conducive to counterfeit prevention of secure identification document In the present invention, the transparent protective layer (not shown) is provided with a transparent anti-counterfeiting mark (401). Since the transparent protective layer (not shown) covers the color portrait, the transparent protective layer shall be destroyed before the color portrait is falsified; as the transparent protective layer (not shown)) is provided with the anti-counterfeiting mark (401), when the transparent protective layer (not shown) is destroyed, part of the content of the anti-counterfeiting mark is inevitably lost, which is convenient for people to identify whether the content of the document has been falsified. The anti-counterfeiting mark (401) may be a Chinese name, initials, the document number, and the like. In this embodiment, the anti-counterfeiting mark comprises initials "LXX", and the initials "LXX" are evenly distributed on the secure identification document.

In the invention, the transparent protective layer completely covers the substrate; the transparent protective layer covers the color portrait layer (200) and the holder's identity information (101) on the substrate, which effectively protects the color portrait layer (200) and the holder's identity information (101).

In the description of this Specification, the descriptions with reference to the terms "an embodiment", "some embodiments", "exemplary embodiments", "examples", "specific examples", or "some examples" mean that the combined embodiments or the specific features, structures, materials, or characteristics described by the examples are included in at least one embodiment or example of the present invention. In this Specification, the schematic expressions of the above terms do not necessarily refer to the same embodiment or example. Furthermore, the particular features, structures, materials, or characteristics described may be combined in any suitable manner in any one or more embodiments or examples.

The above descriptions are only the preferred embodiments of the present invention and are not intended to limit the present invention. Any modification, equivalent replacement, and improvement made within the spirit and principle of the present invention shall be included in the protection range of the present invention.

The invention claimed is:

1. A method for producing a secure identification document with a color portrait, comprising:

etching identity information on a substrate of a data surface of document by laser, and the identity information comprises a black-and-white portrait and text information;

printing a color portrait on a blank space of the substrate with color ink to obtain a personalized data surface; the color portrait is an enlargement of the black-and-white portrait in equal proportion; and printing a transparent protective layer with a transparent varnish on an upper surface of the personalized data surface, and the protective layer covers the color portrait, wherein when the transparent protective layer is printed, a printing thickness of a predetermined region in the transparent protective layer is increased or reduced, and second anti-counterfeiting marks are formed in the predetermined region.

2. The method for producing a secure identification document with a color portrait according to claim 1, wherein, before the transparent protective layer is printed on the upper surface of the personalized data surface, the method comprises:

printing a first anti-counterfeiting mark on the personalized data surface by using optically variable ink; and changing a color of the first anti-counterfeiting mark and curing the first anti-counterfeiting mark sequentially, so that an optically variable mark is generated on the personalized data surface.

3. The method for producing a secure identification document with a color portrait according to claim 2, wherein the step of printing the transparent protective layer on the upper surface of the personalized data surface with a transparent varnish further comprises:

forming the second anti-counterfeiting mark in the transparent protective layer while the transparent protective layer is printed.

4. The method for producing a secure identification document with a color portrait according to claim 3, wherein there are two or more second anti-counterfeiting marks, which are evenly distributed in the transparent protective layer.

5. The method for producing the secure identification document with a color portrait according to claim 4, wherein the color ink comprises color resin ink or offset rotary ink, and that the transparent varnish comprises resin, linseed oil or turpentine, and that the substrate comprises polyvinyl chloride or polycarbonate.

6. The method for producing a secure identification document with a color portrait according to claim 5, wherein the first anti-counterfeiting mark and the second anti-counterfeiting mark are composed of a graphic and/or text.

7. The method for producing a secure identification document with a color portrait according to claim 3, wherein the transparent protective layer covers the color portrait, the transparent protective layer is destroyed before the color portrait is falsified, the transparent protective layer is provided with the second anti-counterfeiting mark, and when the transparent protective layer is destroyed, part of a content of the second anti-counterfeiting mark is lost with which a falsified content of the second anti-counterfeiting mark is identified.

8. The method for producing a secure identification document with a color portrait according to claim 2, wherein the changing the color of the first anti-counterfeiting mark is processed by gas, electricity, light and pressure, which are to change an arrangement of liquid crystals.

9. The method for producing a secure identification document with a color portrait according to claim 2, wherein the first anti-counterfeiting mark is cured by an ultraviolet curing agent and ultraviolet light.

10. The method for producing a secure identification document with a color portrait according to claim 1, wherein the transparent protective layer is printed in a form of a seal to cover the color portrait.

* * * * *